US007461723B2

(12) United States Patent
Kawai

(10) Patent No.: US 7,461,723 B2
(45) Date of Patent: Dec. 9, 2008

(54) FIRE CONTROL SYSTEM OF ELEVATOR

(75) Inventor: Kiyoji Kawai, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 451 days.

(21) Appl. No.: 10/567,663

(22) PCT Filed: Jun. 10, 2004

(86) PCT No.: PCT/JP2004/008136

§ 371 (c)(1),
(2), (4) Date: Feb. 9, 2006

(87) PCT Pub. No.: WO2005/121004

PCT Pub. Date: Dec. 22, 2005

(65) Prior Publication Data

US 2006/0201751 A1 Sep. 14, 2006

(51) Int. Cl.
*B66B 1/20* (2006.01)

(52) U.S. Cl. ..... 187/313; 187/384; 187/392

(58) Field of Classification Search ..... 187/313, 187/316, 317, 380–388, 391–396
See application file for complete search history.

(56) References Cited

U.S. PATENT DOCUMENTS

| | | | | |
|---|---|---|---|---|
| 4,023,146 | A * | 5/1977 | Carroll | 710/113 |
| 5,979,607 | A * | 11/1999 | Allen | 187/390 |
| 7,182,174 | B2 * | 2/2007 | Parrini et al. | 182/18 |
| 7,210,564 | B2 * | 5/2007 | Kawai | 187/384 |
| 2006/0054420 | A1 * | 3/2006 | Gordon et al. | 187/313 |

FOREIGN PATENT DOCUMENTS

| | | |
|---|---|---|
| JP | 2-5660 | 2/1990 |
| JP | 9-48565 | 2/1997 |
| JP | 2002-509850 | 4/2002 |
| JP | 3446996 | 7/2003 |
| JP | 2003-276964 | 10/2003 |
| JP | 2004-203623 | 7/2004 |
| JP | 2005-170529 | 6/2005 |
| WO | 2004-101418 | 11/2004 |

* cited by examiner

*Primary Examiner*—Jonathan Salata
(74) *Attorney, Agent, or Firm*—Oblon, Spivak, McClelland, Maier & Neustadt, P.C.

(57) ABSTRACT

Provided is a fire control system of an elevator which rescues remainders in a building to a rescue floor by causing an elevator car to perform evacuating operations when a fire detector installed in the building works, characterized in that the fire control system of an elevator includes: individual identification sending means which each individual who utilizes the elevator carries and in which a resident room number, a resident floor, information on characteristics of each individual, etc. are registered; individual identification receiving means provided in each elevator hall; and a controller which calls an elevator car and performs car-call registration of a destination floor on the basis of information sent from the individual identification sending means to the individual identification receiving means. The controller includes remainders -on-each-floor measuring means which calculates the number of remainders on each floor from car-call registration information of the destination floor, remainders -on-each-floor detecting means which detects the calculated number of remainders on each floor, evacuation guiding and direction giving means which performs evacuation guidance and giving directions during a fire on the basis of the detected number of remainders on each floor, and rescue operation means which performs rescue operations.

5 Claims, 15 Drawing Sheets

FIG. 5

| MEMORY ADDRESS B+(j) | FLOOR FL(j) | ENROLLMENT Mn(j) | NUMBER OF EMERGENCY-STAIRCASE-EVACUEE Ms(j) | NUMBER OF EVACUEE USED ELEVATOR Me(j) |
|---|---|---|---|---|
| j:1 | FLOOR2 F2 | 300 | 290 | 10 |
| | FLOOR3 F3 | 300 | 250 | 50 |
| | FLOOR4 F4 | 400 | 100 | 300 |
| | FLOOR5 F5 | 300 | 50 | 250 |

33a:EVACUEE-NUMBER TABLE

FIG. 6

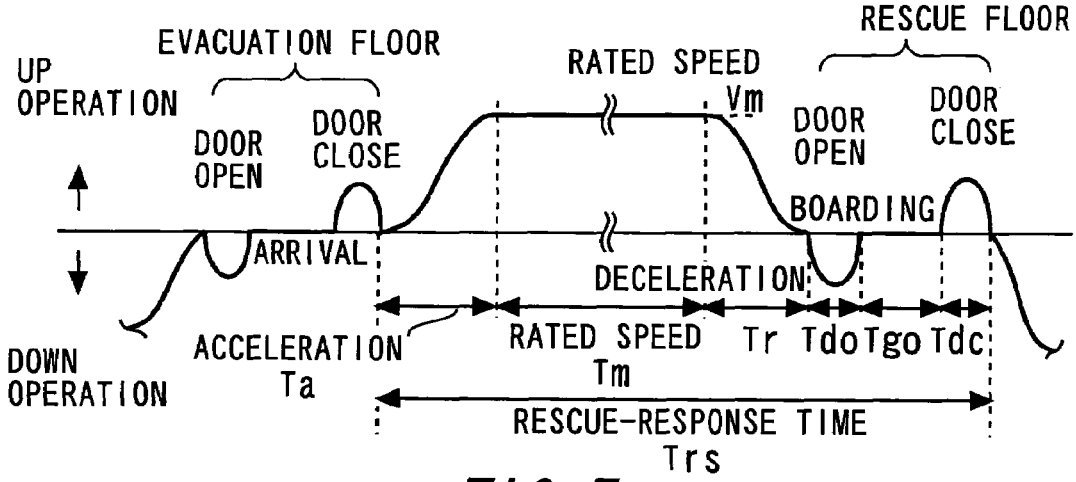

FIG. 7

RATED SPEED Vm=90m/min, IN CASE OF 11PASSENGER UNIT:SECONDS

| MEMORY ADDRESS G+(k) | FLOOR FL FL(k) | DISTANCE FROM EVACUATION FLOOR Ds(k) | ACCELERATION TIME Ta(k) | TIME AT RATED SPEED Tm(k) | DECELERATION TIME Tr(k) | DOOR OPENING-CLOSING TIME Toc(k) (Tdo+Tdc) | BOARDING TIME Tgo(k) | RESCUE-RESPONSE TIME Trs(k) |
|---|---|---|---|---|---|---|---|---|
| k:1 | FLOOR2 F2 | 3 | 1.5 | 0.5 | 1.5 | 4 | 9 | 19.5 |
| | FLOOR3 F3 | 6 | 1.5 | 2.5 | 1.5 | 4 | 9 | 24.5 |
| | FLOOR4 F4 | 9 | 1.5 | 4.5 | 1.5 | 4 | 9 | 29.5 |
| | FLOOR5 F5 | 12 | 1.5 | 6.5 | 1.5 | 4 | 9 | 34.5 |

33b:RESCUE-RESPONSE-TIME TABLE

FIG. 8

| MEMORY ADDRESS E+(g) | FIRE DETECTOR Fde(g) | FLOOR FL(g) | ACTIVATION STATE FNe(g) |
|---|---|---|---|
| g:1 | Fde1 | MACHINEROOM F7 | OFF |
| g:2 | Fde2 | HOISTWAY F6 | OFF |
| g:3 | Fde3 | FLOOR 2 F2 | OFF |
| | Fde4 | FLOOR 3 F3 | OFF |
| | Fde5 | FLOOR 4 F4 | OFF |
| | Fde6 | FLOOR 5 F5 | OFF |

ELEVATOR HALL Eh

33c:FIRE-DETECTOR-ACTIVATION TABLE (MACHINEROOM F7, HOISTWAY F6, ELEVATOR HALL Eh)

FIG. 9

| MEMORY ADDRESS D+(m) | FIRE DETECTOR Fde(m) | FLOOR FL(m) | ACTIVATION STATE FN(m) |
|---|---|---|---|
| m:1 | Fde1 | FLOOR 2 F2 | OFF |
| | Fde2 | FLOOR 2 F2 | OFF |
| | Fde3 | FLOOR 2 F2 | OFF |
| | | | |
| | Fde21 | FLOOR 4 F4 | OFF |
| | Fde22 | FLOOR 4 F4 | ON |
| | Fde23 | FLOOR 4 F4 | ON |
| | | | |
| | Fde28 | FLOOR 5 F5 | OFF |

33d:FIRE-DETECTOR-ACTIVATION TABLE (ROOM Rm)

FIG. 10

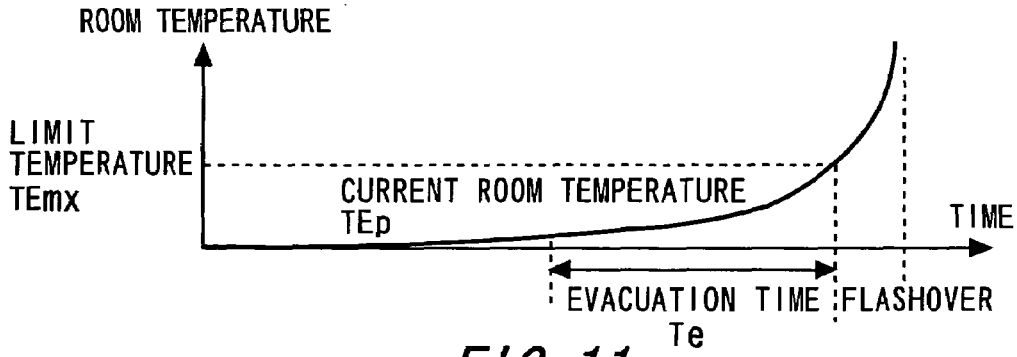

FIG. 11

| MEMORY ADDRESS A+(i) | ELEVATOR HALL FL(i) | CURRENT ROOM TEMPERATURE TEp(i) | EVACUATION TIME Te(i) |
|---|---|---|---|
| i:1 | FLOOR 2 F2 | 24℃ | 90MINUTES |
| | FLOOR 3 F3 | 25℃ | 80MINUTES |
| | FLOOR 4 F4 | 70℃ | 10MINUTES |
| | FLOOR 5 F5 | 50℃ | 20MINUTES |

33e:EVACUATION-TIME TABLE

FIG. 12

| MEMORY ADDRESS U+(p) | FLOOR FL(p) | EVACUATION TIME Te(p) |
|---|---|---|
| p:1 | FLOOR 4 F4 | 10MINUTES |
| | FLOOR 5 F5 | 20MINUTES |
| | FLOOR 3 F3 | 80MINUTES |
| | FLOOR 2 F2 | 90MINUTES |

33f:RESCUE-OPERATION-ORDER TABLE (EVACUATION-TIME SEQUENTIAL)

FIG. 13

| MEMORY ADDRESS F+(h) | FLOOR FL(h) | NUMBER OF EVACUEE USED ELEVATOR Me(h) | NUMBER OF REMAINDER Mrs(h) |
|---|---|---|---|
| h:1 | FLOOR 2 F2 | 10 | 10 |
| | FLOOR 3 F3 | 50 | 50 |
| | FLOOR 4 F4 | 300 | 260 |
| | FLOOR 5 F5 | 250 | 250 |

33g:REMAINDER-NUMBER TABLE

FIRE CONTROL SYSTEM OF ELEVATOR

TECHNICAL FIELD

The present invention relates to a fire control system of an elevator which performs high-accuracy grasping of the number of remainders on each floor and of the characteristics of the remainders when a fire breaks out in a building, thereby to select an optimum evacuating operation and to be able to perform an appropriate rescue guidance for the remainders.

BACKGROUND ART

Fire control systems of an elevator which rescue persons remaining in a building when a fire breaks out have hitherto been known. For example, the U.S. Pat. No. 6,000,505 discloses a multistory building having an elevator system capable of being used to transfer building occupants between floors during a fire. This elevator system can work during a fire as emergency escape and evacuation means that includes a control unit which controls the movement of elevator cars between selected floors within an emergency evacuation zone and evacuates building occupants to a designated evacuation support floor.

The Japanese Patent Laid-Open No. 9-48565 discloses a residential-space watching control system which identifies persons in a place targeted for watching in a residential space, calculates the number of evacuees and residential places, and performs disaster prevention and evacuation guidance management.

According to the International Patent Application No. PCT/JP03/05977, there is proposed a fire control system of an elevator which predicts the time until a fire reaches an elevator hall after the fire breaks outs, thereby to determine the order of rescue operations.

However, in conventional fire control systems of an elevator, the individual identification information of elevator users is not utilized. Therefore, it is difficult to perform high-accuracy grasping of the number of remainders on each floor, and appropriate evacuating operations based on the grasping of the accurate number of remainders, priority evacuating operations based on the grasping of the characteristics of remainders (the weak), supply of evacuation guidance signs to individual remainders and the like are not performed. This is the state of things.

The present invention has been made to solve the above problems and has as its object the provision of a fire control system of an elevator which performs appropriate evacuating operations based on the grasping of the accurate number of remainders on each floor and priority evacuating operations based on the grasping of the characteristics of remainders (the weak) and can inform individual remainders of evacuation guidance signs, etc. when a fire breaks out.

[Patent Document 1]: U.S. Pat. No. 6,000,505

[Patent Document 2]: Japanese Patent Laid-Open No. 9-48565

[Patent Document 3]: International Patent Application No. PCT/JP03/05977

DISCLOSURE OF THE INVENTION

The present invention provides a fire control system of an elevator which rescues remainders in a building to an evacuation floor by causing an elevator car to perform rescue operations when a fire detector installed in the building works. The fire control system of an elevator comprises: individual identification sending means which each individual who utilizes the elevator carries and in which identification information of each individual is registered; individual identification receiving means provided in each elevator hall; and a controller which calls an elevator car and performs car-call registration of a destination floor on the basis of information sent from the individual identification sending means to the individual identification receiving means. The controller includes remainders-on-each-floor measuring means which calculates the number of remainders on each floor from car-call registration information of the destination floor, remainders-on-each-floor detecting means which detects the calculated number of remainders on each floor, and rescue operation means which performs rescue operations on the basis of the detected number of remainders on each floor.

Also, the present invention provides a fire control system of an elevator which comprises: individual identification sending means which each individual who utilizes the elevator carries and in which a residential room number, a residential floor, information on characteristics of each individual, etc. are registered; individual identification receiving means provided in each elevator hall; and a controller which calls an elevator car and performs car-call registration of a destination floor on the basis of information sent from the individual identification sending means to the individual identification receiving means. The controller includes remainders-on-each-floor measuring means which calculates the number of remainders on each floor from car-call registration information of the destination floor and grasps personal characteristics of remainders, remainders-on-each-floor detecting means which detects the calculated number of remainders on each floor and the grasped personal characteristics of remainders, rescue operation means which performs rescue operations on the basis of the detected number of remainders on each floor, and evacuation guiding and direction giving means which performs evacuation guidance and giving directions during a fire on the basis of the grasped personal information of remainders.

BRIEF DESCRIPTION OF THE DRAWINGS

FIGS. 1 to 19 all show a fire control system of an elevator on which the present invention is based;

FIG. 1 is a block diagram which shows the general construction;

FIG. 2 is a longitudinal sectional view of a building;

FIG. 3 is a cross-sectional view taken along the line III-III of FIG. 2;

FIG. 4 is a block diagram which shows an electric circuit;

FIG. 5 is a diagram which shows the contents of an evacuee-number table 33*a;*

FIG. 6 is an explanatory diagram which shows an operation curve of an elevator;

FIG. 7 is a diagram which shows the contents of a rescue-response-time table 33*b;*

FIG. 8 is a diagram which shows the contents of a fire-detector-activation table 33*c* related to an elevator;

FIG. 9 is a diagram which shows the contents of a fire-detector-activation table 33*d* related to resident rooms;

FIG. 10 is an explanatory diagram which shows a temperature rise in an elevator hall Eh when a fire breaks out;

FIG. 11 is a diagram which shows the contents of an evacuation-time table 33*e;*

FIG. 12 is a diagram which shows the contents of a rescue-operation order table 33*f;*

FIG. 13 is a diagram which shows the contents of a remainder-number table 33*g;*

FIG. 14 is a flowchart of a program for detecting fire detector operations in a machine room and a shaft;

FIG. 15 is a flowchart of a program for detecting fire detector operations in an elevator hall;

FIG. 16 is a flowchart of a program for detecting fire detector operations in a resident room;

FIG. 17 is a flowchart of an evacuation time calculating program and a rescue operation order determining program;

FIG. 18 is a flowchart of a program for judging a floor targeted for rescue and a rescue operation command program;

FIG. 19 is a flowchart of a program for calculating the number of remainders;

BEST MODE FOR CARRYING OUT THE INVENTION

Figure 1:
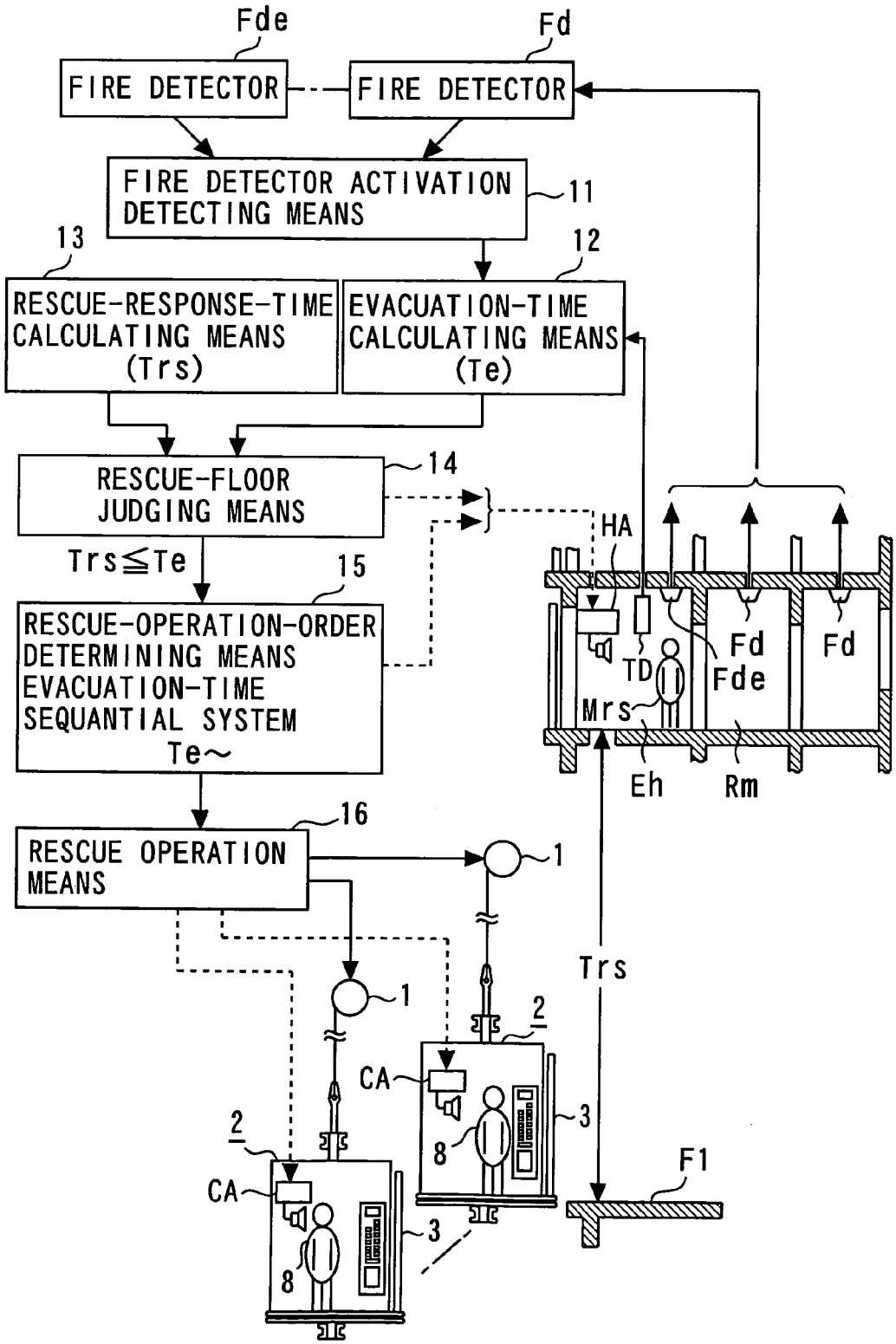

To facilitate an understanding of the present invention, first, a fire control system of an elevator on which the present invention is based will be described with reference to the accompanying drawings of FIGS. 1 to 19. Incidentally, in the drawings, the same or corresponding parts are identified by the same reference numerals and overlapping descriptions of these parts are appropriately simplified or omitted.

This fire control system of an elevator on which the present invention is based is described in the International Patent Application No. PCT/JP03/05977. In this fire control system of an elevator, the number of remainders is calculated from the enrollment which is registered beforehand in a list of names of the enrollment of each floor and the order of rescue operations is such that rescue operations are performed in order of floors targeted for rescue which have short rescue time.

FIG. 1 is a block diagram illustrating the whole structure of the system; a car 2 is driven to ascend and descend by means of a hoisting machine 1, and the entrance is opened and closed by means of car doors 3. Further, a car rescue-operation indicating means CA for notifying the passengers 8 of the switch to rescue operation due to occurrence of fire is provided.

The evacuation floor F1 of the building is a floor provided with special fire countermeasures. The car 2 travels back and forth between the evacuation floor F1 and the rescue floors in case of a fire to rescue the remainders inside the building. In the rooms Rm, fire detectors Fd are provided. In the elevator hall Eh, a fire detector Fde, a temperature detector TD and a hall rescue-operation indicating means HA are provided. The hall rescue-operation indicating means HA indicates whether or not the floor is judged as a rescue floor and notifies the judgment to any remainders Mrs in the elevator hall Eh.

A fire-detector-activation detecting means 11 generates significant signals when it detects activation of the fire detectors Fd and Fde. An evacuation-time calculating means 12 is activated by the significant signals from the fire-detector-activation detecting means 11, and calculates the time for the current temperature TEp of the elevator hall detected by the temperature detector TD to rise to the limit temperature TEmx, i.e., the evacuation time Te, as shown in FIG. 10. A rescue-response-time calculating means 13 calculates the time required for the car 2 to ascend or descend from the evacuation floor F1 to the rescue floor and opens the doors, i.e., the rescue response time Trs, according to the run curve of the elevator shown in FIG. 6.

A rescue floor-judging means 14 compares the evacuation times Te of each floor calculated by the evacuation-time calculating means 12 with the rescue response times Trs required to reach the floors calculated by the rescue-response-time calculating means 13, and judges a floor as a rescue floor when the evacuation time Te is equal to or more than the rescue response time Trs. A rescue-operation-order determining means 15 determines the order of rescue operation in accordance with the evacuation-time sequential system wherein rescue operation is carried out in the increasing order of evacuation time Te. A rescue operation means 16 carries out rescue operation at the floors judged as rescue floors by the rescue floor-judging means 14 in the order determined by the rescue-operation-order determining means 15.

Figure 2:
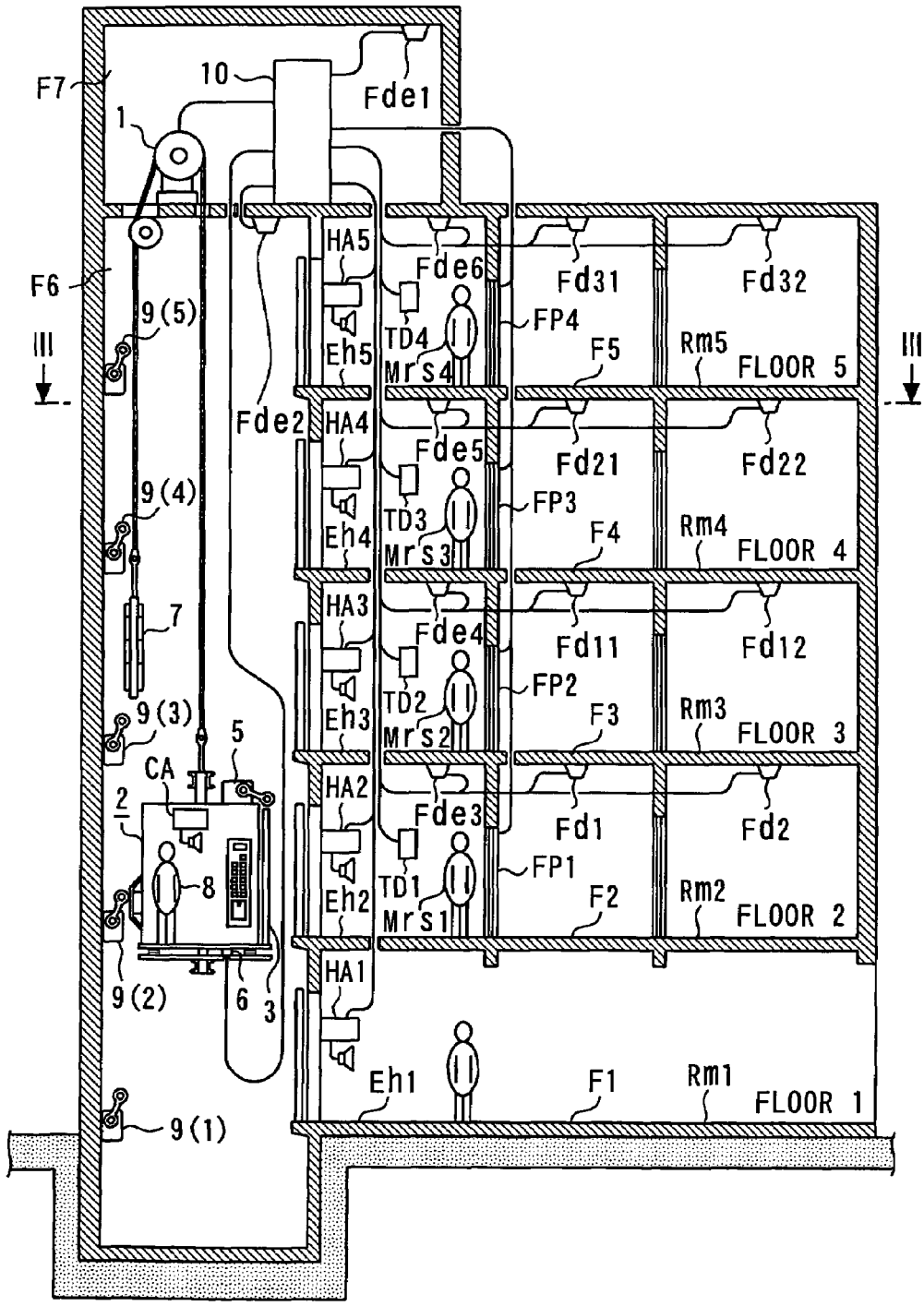

FIG. 2 is a longitudinal sectional view of a building using the fire control system for an elevator. Here, the evacuation floor is the ground floor F1, and the building further includes floors F2 through F5 (second to fifth floors).

Here, the parts having the same reference mark as in FIG. 1 except for the final number thereof are the same as the parts in FIG. 1; and the final number means that the part is provided on a different location. For example, HA1 designates a hall rescue-operation indicating means that is provided on the evacuation floor F1, and Fd1 designates a fire detector provided in a room Rm on the second floor F2. In the below-mentioned, the final number will be omitted when refered to generically.

In FIG. 2, the car 2 is housed in a hoistway F6 together with a counterweight 7, and is driven to ascend and descend by a hoisting machine 1 provided in a machineroom F7. Position switches 9 (1) to 9(5) are provided on each of the floors F1 to F5, and activate upon arrival of the car 2. These switches will be generically named "position switches 9". The car doors 3 open and close upon arrival of the car 2, and a door switch 5 activates when the car doors 3 close. In each of the elevator halls Eh2 to Eh5 of the second to fifth floors F2 to F5, fire doors FP1 to FP4 are provided, and are shut upon necessity. The equipment is connected to an elevator control device 10 provided in the machineroom F7.

Figure 3:
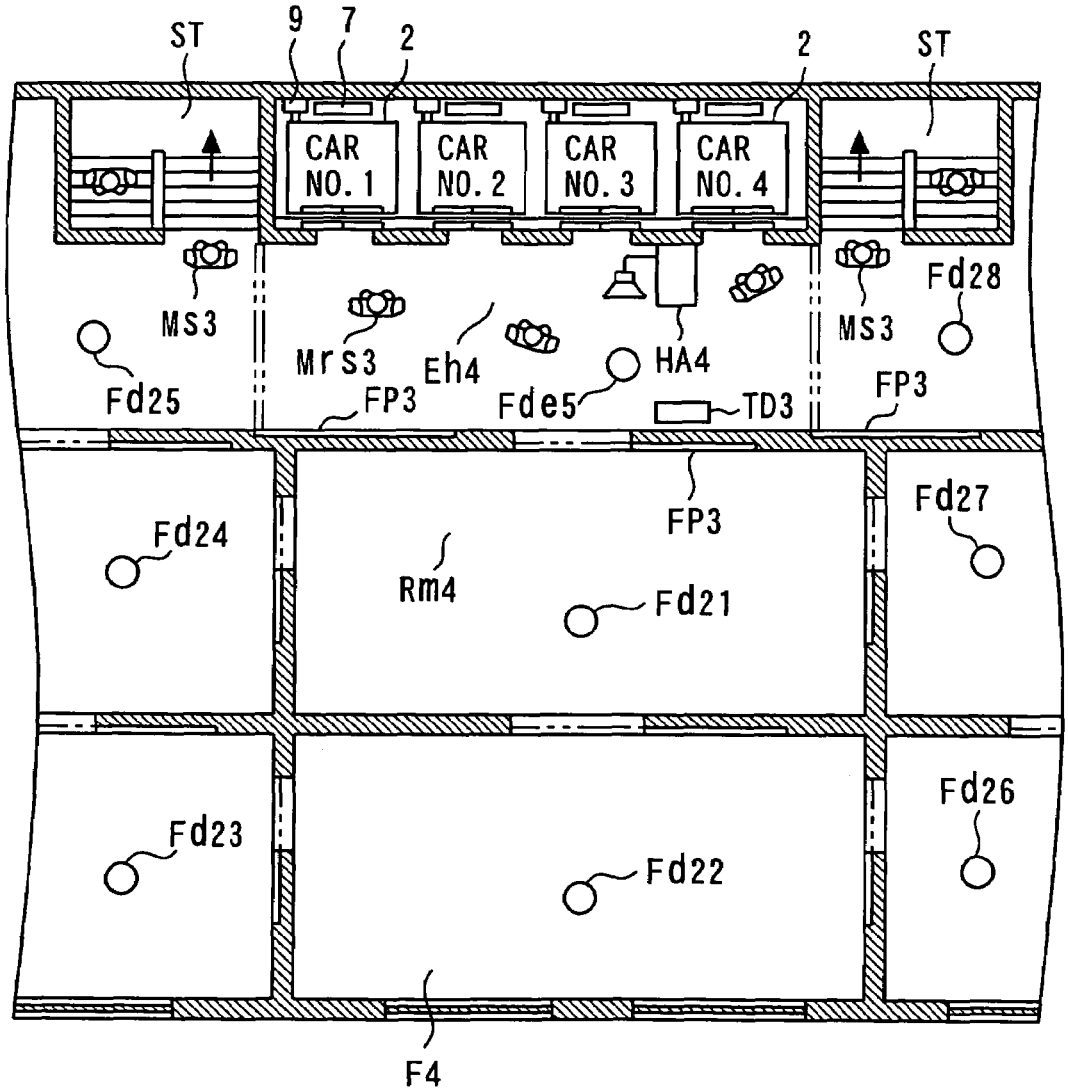

FIG. 3 is a cross sectional view taken along line III-III, and shows a plane of the fourth floor F4.

Similarly, the parts having the same reference mark as in FIG. 1 except for the final number thereof are the same as the parts in FIG. 1; and the final number means that the part is provided on the fourth floor F4.

In FIG. 3, at both sides of the elevator hall Eh4, emergency staircases ST are provided, and emergency-staircase-evacuees Ms3 evacuate thereby.

Figure 4:
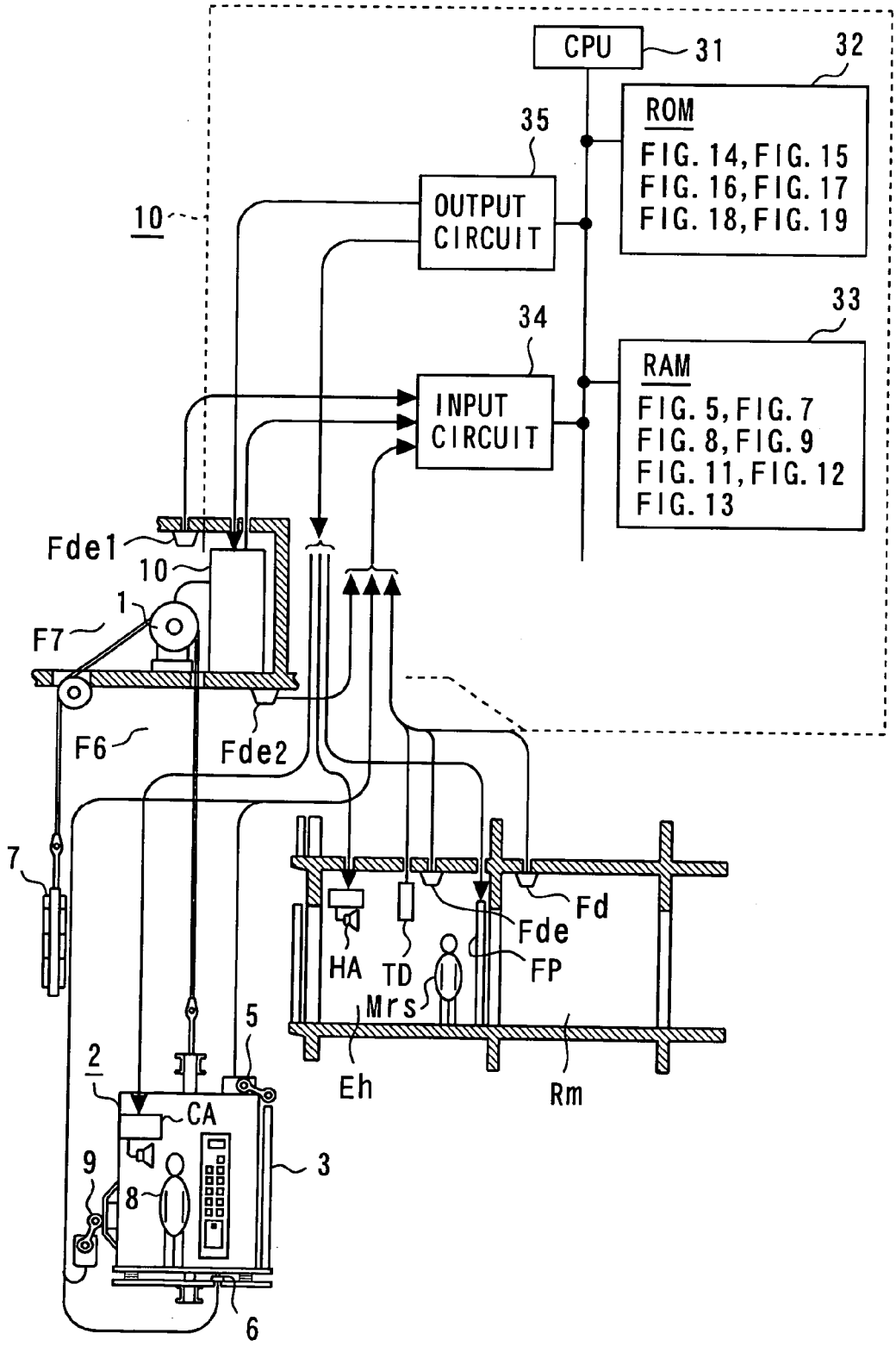

FIG. 4 is a block diagram illustrating an electric circuit of the fire control system.

An ROM 32 is connected to the bus line of a central processing unit (CPU) 31. In the ROM 32, a program for detecting activation of the fire detectors Fde1, Fde2 and Fde3 to Fde 5 (generically named "Fde" when referred to as elevator-related fire detectors in the following) which are provided in the machineroom F7, the hoistway F6 and the elevator halls Eh; a program for detecting activation of a fire detector Fd provided in a room Rm; a program for calculating the evacuation time Te; a program for determining the order of rescue operation; a program for judging whether or not the floor is a rescue floor; a program for commanding rescue operation; and a program for calculating the number of remainders Mrs; are recorded.

An RAM 33 comprises of a memory in which is recorded: an evacuee-number table 33*a* of the number of evacuees of each floor; a rescue-response-time table 33*b* in which is recorded the times for rescue using the elevator from the evacuation floor F1 to each of the floors; a fire-detector-activation table 33*c* for recording the activation situation of the elevator-related fire detector Fde; a fire-detector-activation table 33*d* for recording the activation situation of the fire detector Fd provided in the room Rm; an evacuation-time table 33*e* in which is recorded the time for the fire to spread to the elevator hall Eh; a rescue-operation order table 33*f* for recording the order of rescue operation in increasing order of evacuation time; a remainder-number table 33*g* for recording the number of remainders awaiting rescue on each floor; and temporary data.

The fire detectors Fde and Fd, a temperature detector TD, a door switch 5, a weighing device 6, and an elevator control device 10 are connected to an input circuit 34. Signals of the position, and start and stop of the car 2 are inputted from the elevator control device 10.

An output circuit 35 is connected to an elevator control device 10, a car rescue-operation indicating means CA, a hall rescue-operation indicating means HA provided on each floor, and a fire door FP, which separates the elevator hall Eh.

The CPU 31, the ROM 32, the RAM 33, the input circuit 34, the output circuit 35 and the elevator operation circuit are placed inside the elevator control device 10. Further, the data to be written in the RAM 33 is written manually as well as by the operation signals from other devices.

FIG. 5 is a table representing the contents of an evacuee-number table 33*a*, and an example based on the building in FIG. 2 is given. The floor FL(j) is a memory address in which the number of the floor is recorded. Similarly, the enrollment Mn(j) is a memory address in which the enrollment pre-registered on the list for each floor is recorded. The number Ms (j) of emergency-staircase-evacuees is a memory address in which is recorded the number of persons on the enrollment on the list for each floor estimated to evacuate using the emergency staircase ST. The number Me(j) of elevator-evacuees is a memory address in which is recorded the number of persons of the enrollment estimated to evacuate using an elevator.

Accordingly, when j is 1, the floor FL(j) becomes FL1, and the second floor F2 is recorded in that address. Similarly, the enrollment of 300 persons of the second floor F2 is recorded on the enrollment Mn1. The number of emergency-staircase-evacuees of the second floor F2 of 290 persons is recorded in the number of emergency-staircase-evacuees Ms1. The number of elevator-evacuees of the second floor F2, i.e., 10 persons, is recorded in the number of elevator-evacuees Me1.

The floor FL(j) is a memory address in which is recorded the number of the floor; however, in the following explanation, this may also refer to the number of the floor recorded in that address. That is, the floor FL1 is the second floor F2, when j equals 1. Similarly, the enrollment Mn(j), the number Ms(j) of emergency-staircase-evacuees, and the number Me(j) of elevator-evacuees may refer to the contents recorded in the respective addresses.

FIG. 6 shows the run curve of the elevator; the rescue response time Trs required for the car 2 to reach a floor for rescue consists of an acceleration time Ta, a time Tm to travel at rated speed, a deceleration time Tr, a time Tdo for the doors to open, a boarding time Tgo for the evacuees to board the car 2 at the rescue floor, and a time Tdc for the doors to close.

The opening and closing time Toc of the doors is fixed. Assuming that the number of persons boarding is equal to the riding capacity of the car 2, the time Tgo for the evacuees to board also becomes fixed. Accordingly, the rescue response time Trs can be calculated if the distance Ds from the evacuation floor F1 is specified.

FIG. 7 shows an actual example representing the contents of a rescue-response-time table 33*b*, and is an example of the rescue response time Trs necessary for an elevator of a rated speed of 90 m per minute and having the carrying capacity of 11 persons to carry out rescue at each of the floors.

Here, in the case where k is 1, the second floor F2 is recorded as the floor FL1, 3 m is recorded as the distance Ds1 from the evacuation floor F1, 1.5 seconds is recorded as the acceleration time Ta, 0.5 seconds as the time Tm1 traveling at the rated speed, 1.5 seconds as the acceleration time, 4 seconds as the opening and closing time Toc of the doors, and 9 seconds as the boarding time Tgo assuming that 11 persons are boarding. Accordingly, the rescue response time Trs totals 19.5 seconds. The same applies to the rest of the floors.

The floor FL1 in the case where k is 1 and the floor FL1 in the case where j is 1 in FIG. 5 indicate different memory addresses. To explain in detail, when k is 1 the (C+1) address is indicated, and when j is 1 the (B+1) address is indicated. Accordingly, the floor FL1 when k is 1 and the floor FL1 when j is 1 are recorded in different addresses, and one address is never repeatedly used. The same applies to the rest of the floors.

FIG. 8 is a table representing the contents of an elevator-related fire-detector-activation table 33*c* in which is recorded the state of activation of the elevator-related fire detectors, and is an example based on the building shown in FIG. 2.

In the case where g is 1, the fire detector Fde1 is recorded in the memory address Fde1, the machineroom F7, which is the floor onto which the fire detector Fde1 is fixed, is recorded in the memory address FL1, and an "OFF" showing the state of activation is recorded in the memory address FNe1. When g is 2, the state of activation of the fire detector Fde2 in the hoistway F6 is recorded. When g is 3 to 6, the states of activation of the fire detectors Fde3 to Fde6 of the elevator halls Eh are recorded. The same applies to the rest of the elevator-related fire detectors.

FIG. 9 is a table representing the contents of a room-related fire-detector activation table 33*d*, and is an example based on the building show in FIG. 2.

In the case where m is 1, the fire detector Fd1 is recorded in the memory address Fd1; the second floor F2 is recorded in the memory address FL1, in which is recorded the floor onto which the fire detector Fd1 is fixed; and an "OFF" is recorded in the memory address FN1 showing the state of activation of the fire detector Fd1.

The same applies to the rest; the fire detector Fd22 recorded in the memory address Fd22 when m is 22 shows by the entry in the memory address FL22 that the fire detector Fd22 is provided on the fourth floor F4, and that the state of activation thereof is recorded as "ON" in the memory address FN22 and that the fire detector Fd22 is activated. The same applies to the case where m is 23, and shows that the fire detector Fd23 is activated.

FIG. 10 is a diagram for explaining the rise in temperature in an elevator hall Eh in accordance with the lapse of time from the occurrence of fire.

That is, the room temperature of the elevator hall Eh is detected by a temperature detector TD. Assuming that the highest room temperature enabling rescue operation is the limit temperature TEmx, the time for the current room temperature TEp to rise to the limit temperature TEmx becomes the evacuation time Te. The evacuation time Te does not always shorten according to the lapse of time. Actually, the sprinkler is activated and fire extinction is carried out, so the current room temperature TEp may become lower. In the case where the current room temperature TEp becomes lower, the evacuation time Te becomes longer. For this reason, the evacuation time Te should be constantly calculated by detecting the room temperature of the elevator hall Eh by the temperature detector TD.

FIG. 11 is a table representing the contents of an evacuation-time table 33*e*, and is an example based on the building shown in FIG. 2.

In the case where i is 1, the second floor F2 is recorded in the memory address FL1; the current room temperature TEp 24° C. read from the temperature detector TD1 is recorded in the memory address TEp1; and the evacuation time Te=90 minutes is recorded in the memory address Te1. The same applies to the rest of the room-related fire detectors.

FIG. 12 is a table representing the contents of a rescue-operation order table 33*f*, and the floors are listed from top to bottom in the increasing order of their evacuation times Te which are recorded in the evacuation-time table 33*e*.

In the case where p is 1, each of the values where i is 4 is recorded. That is, in FIG. 12, the fourth floor F4 is recorded in the memory address FL1, and 10 minutes is recorded in the memory address Te1. The same applies to the rest of the floors.

As aforementioned, the memory address FL1 in the case where p is 1, and the memory address FL1 in the case where i is 1 in FIG. 11 are different memory addresses. To describe in further detail, the memory address FL1 where p is 1 indicates the memory address (U+1), and the memory address FL1 where i is 1 indicates the memory address (A+1). Accordingly, these two memory addresses are different, and are never repeatedly used. The same applies to the memory address Te1.

FIG. 13 is a table representing the contents of a remainder-number table 33*g*, wherein the number of persons obtained by subtracting the number of evacuees rescued during the rescue operation until that time with the number of elevator-evacuees Me recorded in the table 33*a* of the number of evacuees in FIG. 5 as the initial value is calculated for each floor and recorded as the number of remainders Mrs. Accordingly, the number of elevator evacuees the elevator Me and the number of remainders Mrs are identical until rescued during rescue operation.

That is, in the case where h is 1, the second floor F2 is recorded in the memory address FL1 indicating the floor; the number of elevator-using evacuees, i.e., 10 persons, which is transferred from the table 33*a* of the number of evacuees is recorded in the memory address Me1; and the number of remainders, i.e., 10 persons, is recorded in the memory address Mrs1. The same applies to the rest of the floors.

In the case where h is 3, 300 is the number of persons recorded in the memory address Me3, and 260 is the number of persons recorded in the memory address Mrs3. This means that 40 persons are already rescued by means of an elevator.

Next, the motion of the fire control system for an elevator will be explained based on FIG. 14 to FIG. 19. This motion is repeated at a fixed time interval.

Figure 14:
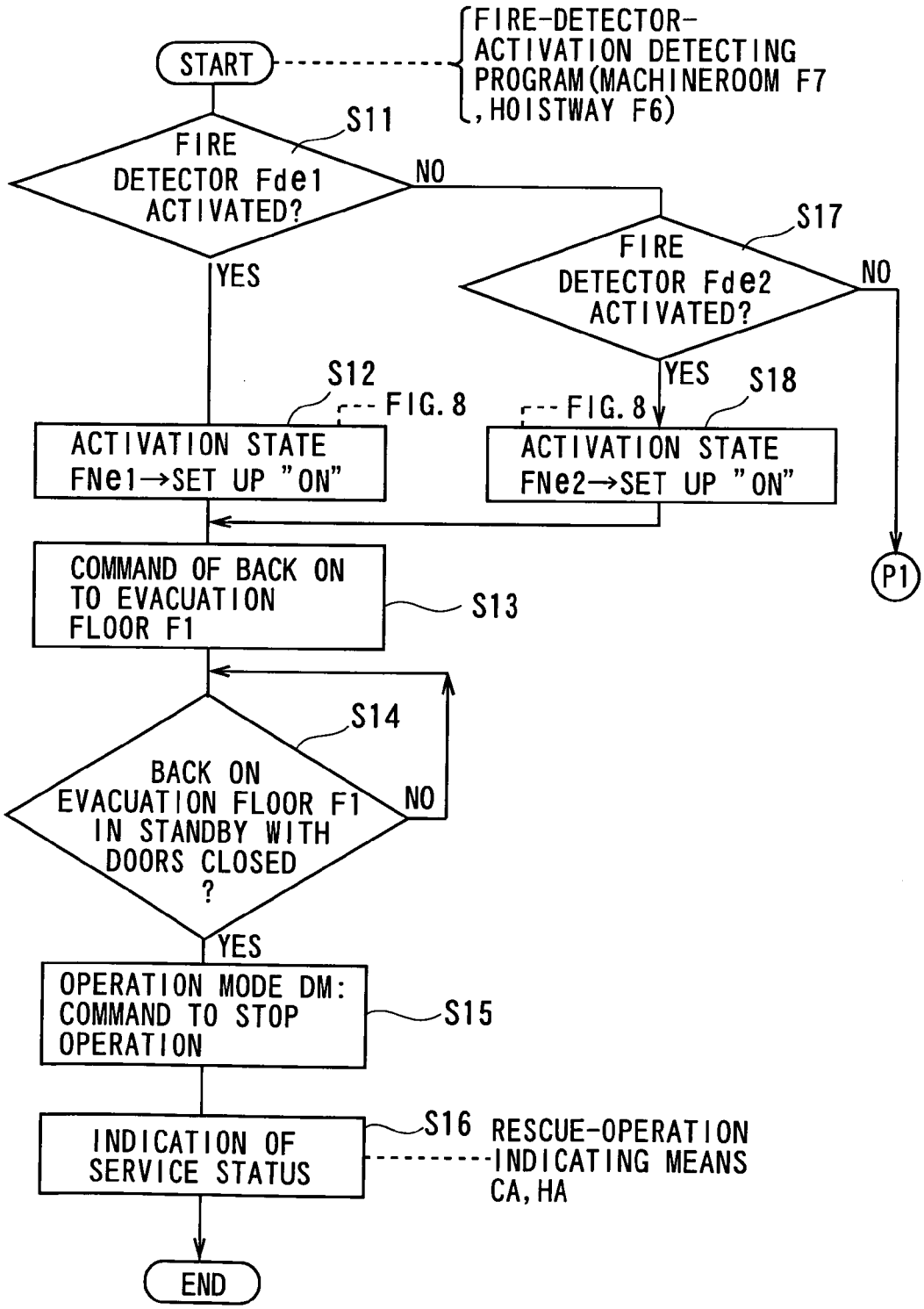

FIG. 14 is a program for detecting activation of the fire detectors Fde1 and Fde2 provided in the machineroom F7 and the hoistway F6.

In step S11, a check is made on whether the fire detector Fde1 of the machineroom F7 is activated. If the fire detector Fde1 is activated, the memory address (hereinafter referred to as 'activation state') FNe1 indicating the activation state of the fire detector activation table 33*c* is set to "ON" in step S12. In step S13, a command is given to the elevator control device 10 to return the car 2 to the evacuation floor F1. After the car 2 returns to the evacuation floor F1 and opens its doors and closes them again and becomes in standby in step S14, the operation mode DM is set to out of operation in step S15. In step S16, a notice of "out of service" is indicated by the car rescue-operation indicating means CA and the hall rescue-operation indicating means HA, and the process is completed. Accordingly, in this case, rescue operation is not carried out.

In the case where the fire detector Fde1 of the machineroom F7 is not activated in step S11, the process moves on to step S17, and a check is made on whether or not the fire detector Fde2 of the hoistway F6 is activated. If the fire detector Fde2 is activated, the activation state FNe2 is set to "ON", and the process moves on to step S13 and is followed as mentioned above.

Figure 15:
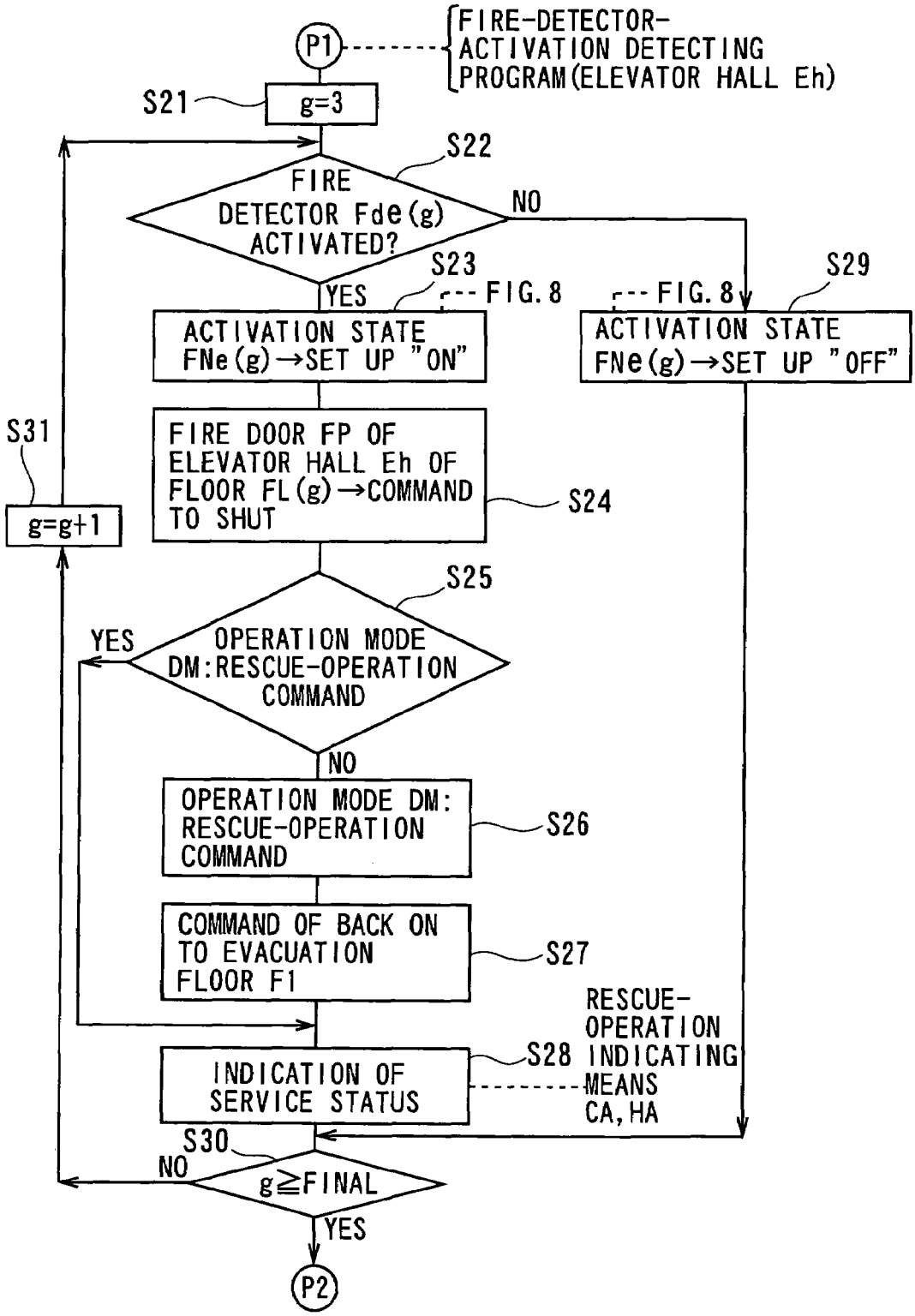

In the case where the fire detector Fde2 of the hoistway F6 is not activated in step S17, the process moves on to the process shown in FIG. 15.

FIG. 15 is a program for detecting activation of the fire detectors Fde3 to Fde6 provided in the elevator halls Eh.

In step S21, g is set to 3, and in step S22, activation of the fire detector Fde3 of the second floor F2 is checked. If the fire detector Fde3 is activated, the activation state FNe3 of the fire detector activation table 33*c* is set to "ON" in step S23. In step S24, a command to close is given to the fire doors FP1 of the elevator hall Eh2 of the second floor F2. In the case where the operation mode DM is not yet switched to the rescue operation command in step S25, the operation mode DM is set to the rescue operation command at step S26, and a command is given to the elevator control device 10 at step S27 to return the car 2 to the evacuation floor F1. In step S28, a notice of "in rescue operation" is indicated by the rescue-operation indicating means CA and HA. In the case where the operation mode DM is already switched to the rescue operation command in step S25, the process moves on to step S28 and the aforementioned notice is indicated, and moves further on to step S30.

In the case where the fire detector Fde3 is not activated in step S22, the process moves on to step S29 and the activation state FNe3 of the fire detector activation table 33*c* is set to "OFF", and then moves on to step S30.

Figure 16:
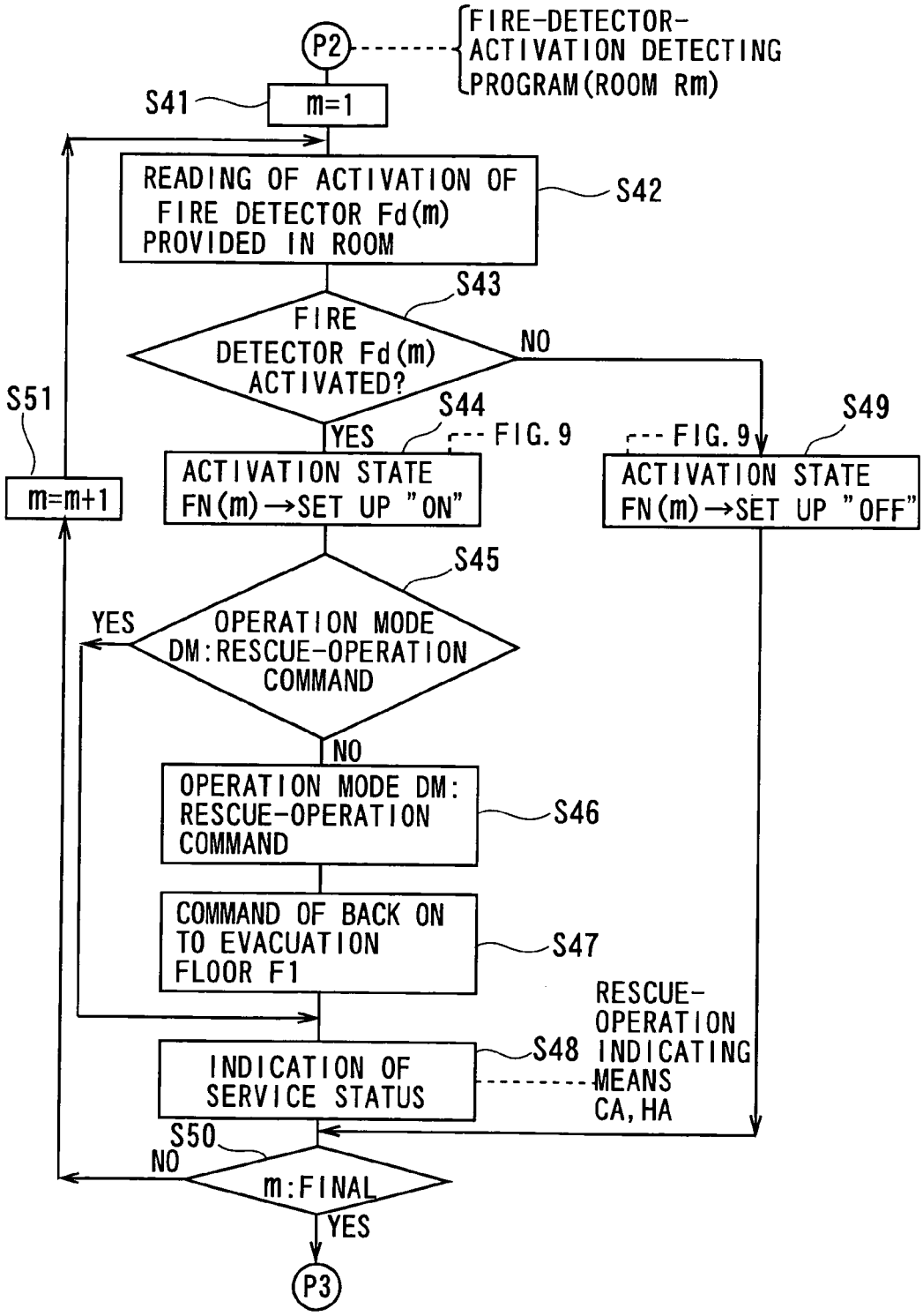

The same process is put in motion via step S30 and step S31 until the process for the final fire detector Fde(g) provided in the elevator hall Eh is completed, and then the process moves on to the process shown in FIG. 16.

FIG. 16 is a program for detecting activation of fire detectors Fd(m) provided in the rooms Rm.

In step S41, m is set to 1. Here, the variable m shows that it is related to the fire detector activation table 33*d* shown in FIG. 9. In step S42 and step S43, a check is made on whether or not the fire detector Fd1 is activated. If the fire detector Fd1 is activated, the activation state FN1 of the fire detector activation table 33*d* is set to "ON" in step S44. In the case where the operation mode DM is not yet switched to the rescue operation command in step S45, the operation mode DM is set to the rescue operation command in step S46, and a command is given to the elevator control device 10 in step S47 to return the car 2 to the evacuation floor F1. In step S48, a notice of "in rescue operation" is indicated by the rescue-operation indicating means CA and HA. In the case where the operation mode DM is already switched to the rescue operation command in step S45, the process moves on to step S48 and the aforementioned notice is indicated, and moves further on to step S30.

In the case where the fire detector Fd1 is not activated in step S43, the process moves on to step S49 and the activation state FN3 of the fire detector activation table 33*d* is set to "OFF", and then moves on to step S50.

Figure 17:
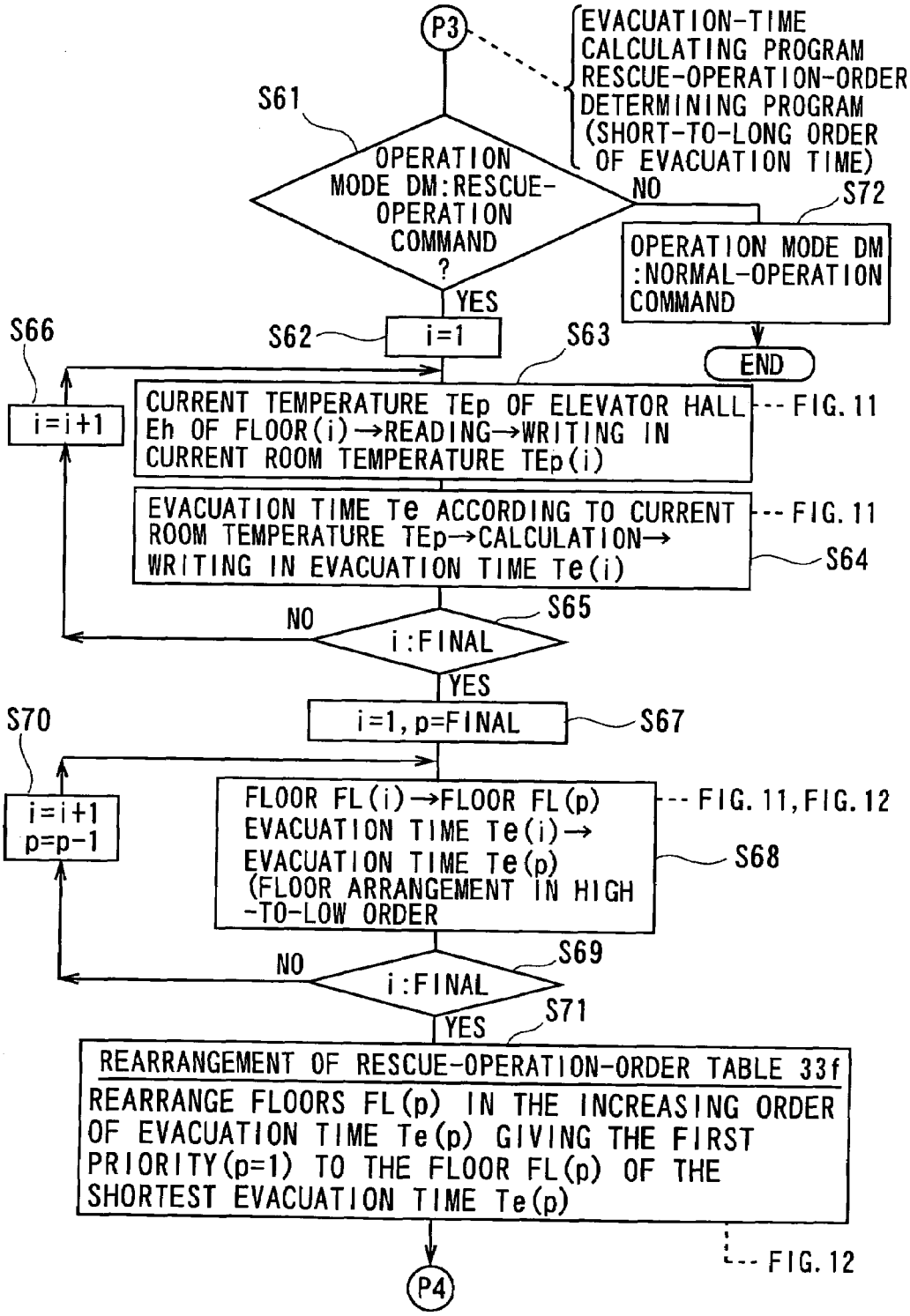

The same process is put in motion via step S50 and step S51 until the process for the final fire detector Fd(m) provided in the elevator hall Eh is completed, and then the process moves on to the process shown in FIG. 17.

FIG. 17 is a program for determining the order of rescue operation by calculating the evacuation times Te.

In step S61, a check is made on whether or not the operation mode DM is the rescue operation command.

In the case where the operation mode DM is not the rescue operation command, the process moves on to step S72 and the operation mode DM is set to the normal operation command, and the process is completed.

In the case where the operation mode DM is the rescue operation command, i is set to 1 in step S62. Here, since the variable i is related to the evacuation-time table 33*e* shown in FIG. 11, the floor FL1 is the second floor F2. In step S63, the current room temperature TEp of the floor FL1, i.e., the second floor F2, is read from the temperature detector TD1, and is recorded in the current room temperature TEp1 of the evacuation-time table 33*e*. In step S64, the evacuation time Te according to the room temperature TEp is calculated based on FIG. 10, and is recorded in the evacuation time Te1 in the evacuation-time table 33*e*. The same process is repeated via step S65 and step S66 until the process for the last variable i is finished and the evacuation-time table 33*e* is completed; then the process moves on to step S67.

Step S67 to step S71 are steps to determine the order of rescue operation according to the evacuation-time table 33*e*.

During rescue operation, priority is given to high floors. Therefore, in the processes of step S67 to step S70, a rescue-operation order table 33*f* is made up by changing the arrangement of the floors to the high-to-low order from the evacuation-time table 33*e* in which the floors are arranged in the low-to-high order. Furthermore, in step S71, the floor FL(p) of which the evacuation time Te(p) is the shortest in the rescue-operation order table 33*f* is recorded in the earliest memory address, i.e., the memory address where p is 1. After the rescue-operation table 33*f* is completed by rearranging the floors in the increasing order of evacuation time Te(p), the process moves on to the process shown in FIG. 18. Here, since the rearrangement process in step S71 is already mentioned, detailed explanation will be omitted.

Figure 18:
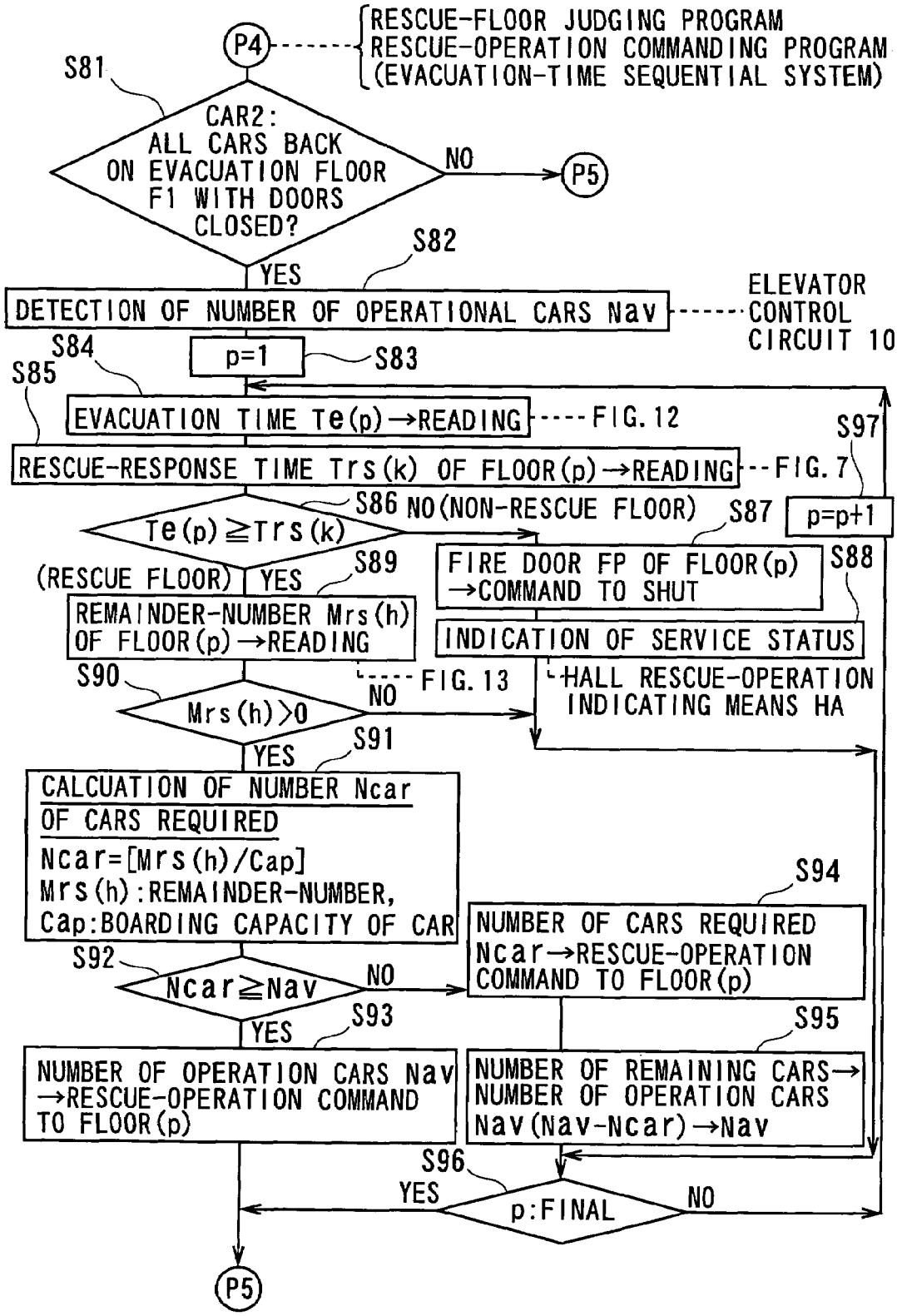

FIG. 18 is a program for judging rescue floor and for commanding rescue operation in the determined order.

In step S81, a check is made on whether all the cars 2 are back on the evacuation floor F1 and are in standby with doors closed. In the case where the cars 2 are not in standby with doors closed, the process moves on to the process shown in FIG. 19. In the case where the cars 2 are in standby with doors closed, in step S82, the number of cars that are ready for rescue operation is detected by the elevator control device 10 and written in the number Nav of cars. In step S83, the variable p is set to 1. In step S84, the evacuation time Te1, i.e. 10 minutes, is read from the rescue-operation table 33*f*. In step S85, the rescue-response time Trs(k) for the floor FL1 is read out. That is, since the variable p is related to the rescue-operation order table 33*f* shown in FIG. 12, the floor FL1 becomes the fourth floor F4. Accordingly, the rescue-response time Trs(k) becomes 29.5 seconds, which is the rescue-response time Trs(4) for the fourth floor F4 in FIG. 7. In step S86, the evacuation time Te1, i.e., 10 minutes, and the rescue-response time Trs(4), i.e., 29.5 seconds, are compared. Since the evacuation time Te1, i.e., 10 minutes, is longer, the process moves on to step S89, and the number Mrs(h) of remainders is read out. Since the floor FL1 is the fourth floor F4 also here, in FIG. 13, the number Mrs4 of remainders becomes 260. Accordingly, the process moves from step S90 to step S91, and the number Ncar of cars required for rescuing the remainders Mrs4 of 260 persons is calculated. That is, $$\text{number } Ncar \text{ of cars required} = (\text{number } Mrs4 \text{ of remainders} = 260) / (\text{capacity } Cap \text{ of car} = 11) = 23.6 \text{ cars},$$

where the capacity Cap of the car 2 is 11. Raising the number to the nearest whole number makes 24 cars. Since the number Ncar of cars required is not less than the number Nav of all the operational cars, i.e., four, the process moves on to step S93 where a rescue-operation command to move to the floor FL1=the fourth floor F4 is given to all the operational cars 2, and then moves on to the program of FIG. 19. The elevator operation circuit drives the cars 2 to the fourth floor F4 according to the above-described rescue-operation command.

In the case where the number Mrs(h) of remainders has decreased and not all of the operational cars Nav are required in step S92, the process moves on to step S94, and a command is given to forward the number of required cars Ncar to the floor FL(p). In step S95, the number of remaining cars (Nav-Ncar) is newly set as the number Nav of operational cars. In step S96, in the case where rescue operation has been carried out on the final floor FL(p), the process moves on to the program shown in FIG. 19. In the case where rescue operation has not been carried out on the final floor FL(p), the process moves on to step S84 via step S97, and the evacuation time Te(p) for the next floor FL(p) is read out. The above-mentioned processes are repeated.

In the case where the current room temperature TEp rises and the evacuation time Te(p) decreases and becomes less than the rescue-response time Trs(k) in step S86, the process moves on to step S87, and a command to shut the fire door(s) FP of that floor FL(p) is given. In step S88, an indication "not available for evacuation" is given by the hall rescue-operation indicating means HA, and the process moves on to step S96. In the case where rescue operation is carried out for the final floor FL(p), the process moves on to the program shown in FIG. 19.

Figure 19:
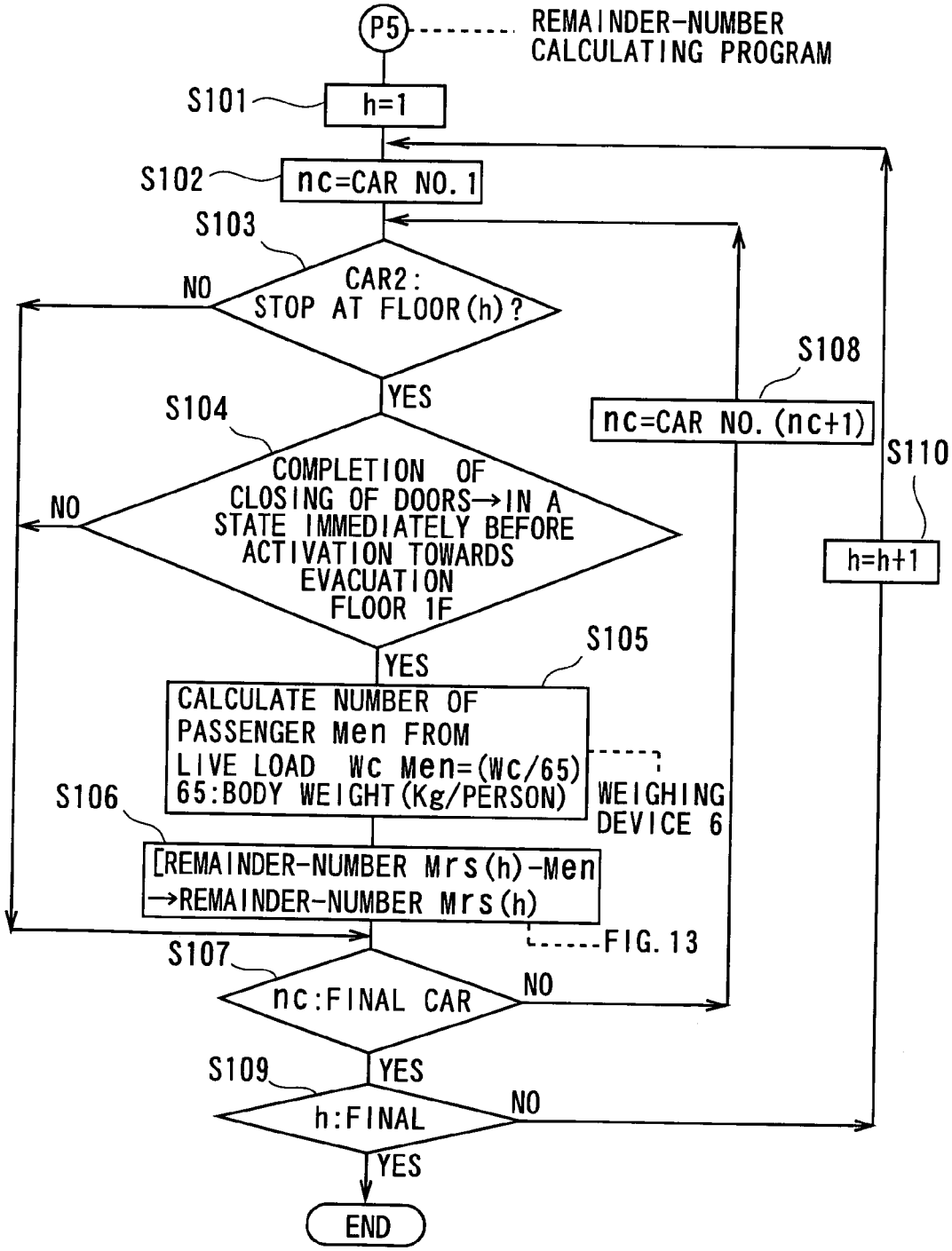

FIG. 19 is a program for calculating the number of remainders of each of the floors. Since the number of remainders changes due to rescue operation, the number is amended in accordance with the change.

In step S101, the variable h is set to 1. In step S102, the variable nc indicating the car number of the car 2 is set to 1. In step S103, a check is made on whether or not car No. 1 is stopped at the floor FL(h), i.e., floor FL1. Since the variable h is related to the remainder-number table 33*g* shown in FIG. 13, the floor FL1 becomes the second floor F2.

Step S103 and step S104 are processes for detecting the timing for weighing the live load Wc of the car 2 by means of a weighing device 6. That is, in step S103 a check is made on whether or not the car 2 is stopped at the second floor F2, and in step S104 a check is made on whether or not the car 2 is in a state immediately before closing of the doors 3 and before activation towards the evacuation floor F1. In the case where the two above-mentioned conditions are not satisfied, the process moves on to step S107. In the case where both of the two above-mentioned conditions are satisfied, the output from the weighing device 6 is read out and the live load Wc is calculated in step S105. The number Men of passengers is calculated by dividing the live load Wc by the weight per person, i.e., 65 kilograms. In step S106, the formula

[number Mrs1 of remainders−number Men of passengers]

is calculated, and the result thereof is written as a new number Mrs1 of remainders. By this writing, the number Mrs1 of remainders is amended. In step S107 and step S108, the same processes are carried out for the next car. After the processes for the final car are completed, the same processes are carried out in step S109 and S110 where h is 2, i.e., for the floor FL2, which is the third floor F3. The process is completed when the processes for the final floor is completed in step S109.

The processes of one cycle of the rescue operation are completed as mentioned above. After a predetermined interval of time, the process is restarted beginning from step S11 of FIG. 14 to carry out rescue operation according to the changes in the conditions of the fire.

According to the above-described first embodiment, the evacuation time Te, which is the time for the smoke and fire to reach the elevator hall, of each of the floors is calculated, a floor of which the evacuation time Te is longer than the time Trs for making a car 2 to respond to a rescue call newly from the evacuation floor F1 is judged as a rescue floor, and a floor of which the evacuation time Te is shorter than the time for making a car respond to a rescue call is judged as a non-rescue floor, and the remainders on the rescue floor are rescued. Thus, it is possible to carry out rescue operation before the fire reaches the elevator.

Furthermore, since rescue operation is carried out on the rescue floor in the increasing order of evacuation time Te, it is possible to rescue the remainders starting with the floor of the highest urgency, and to realize rescue operation suitable for the conditions of the fire.

Moreover, the elevator-evacuees Me is the number of persons obtained by subtracting the number of emergency-staircase-evacuees from the number of persons pre-registered on the enrollment of each floor, and the number Mrs of remainders is obtained by subtracting the number of persons rescued by means of an elevator at that point of time from the above-mentioned evacuees Me. Thus, as for office buildings with few visitors, it is possible to figure out the accurate number Mrs of remainders, and to realize efficient rescue operation, since the car 2 will not be in service to the floors with no remainders Mrs.

Furthermore, since all the cars 2 are activated from the evacuation floor F1 to the selected rescue floor simultaneously so as to arrive almost at the same time, it is possible to prevent panic during evacuation.

Moreover, since the number of cars 2 required to transport the remainders Mrs on the rescue floor is assigned and simultaneously activated from the evacuation floor F1, and the number of cars 2 are required to transport the remainders on the rescue floors of the following priorities are sequentially assigned from the remaining cars 2, no redundant cars 2 are assigned to one rescue floor. Thus, it is possible to improve transportation efficiency during rescue operation, and to rescue the remainders in a short time.

Furthermore, because a hall rescue-operation indicating means HA is provided in the elevator hall to indicate the rescue-operation situation, it is possible for the remainders Mrs in the elevator hall Eh to easily judge whether or not the elevator will respond to a rescue call.

Moreover, since a car rescue-operation indicating means CA is provided also inside the car 2, it is possible to notify the passengers 8 inside the car 2 of the occurrence of emergency.

Also, the elevator hall Eh of each floor is provided with a fire door(s) FP, and the elevator hall Eh of floors which are judged as a non-rescue floor is separated by the fire door FP. Thus, it is possible to separate the elevator hall Eh from the rooms Rm used by people and to prevent spreading of fire, and also to prevent the remainders Mrs from crowding in the elevator hall Eh.

In the above-described first embodiment, an example where the building is a five-story building is given, however, the building to which the system is applied is not limited to a five-story building. The system may be applied by generating tables corresponding to each of the data tables 33*a* to 33*g* to suit the building. This fact is easily known by analogy from the above-mentioned.

EMBODIMENT 1

Figure 20:
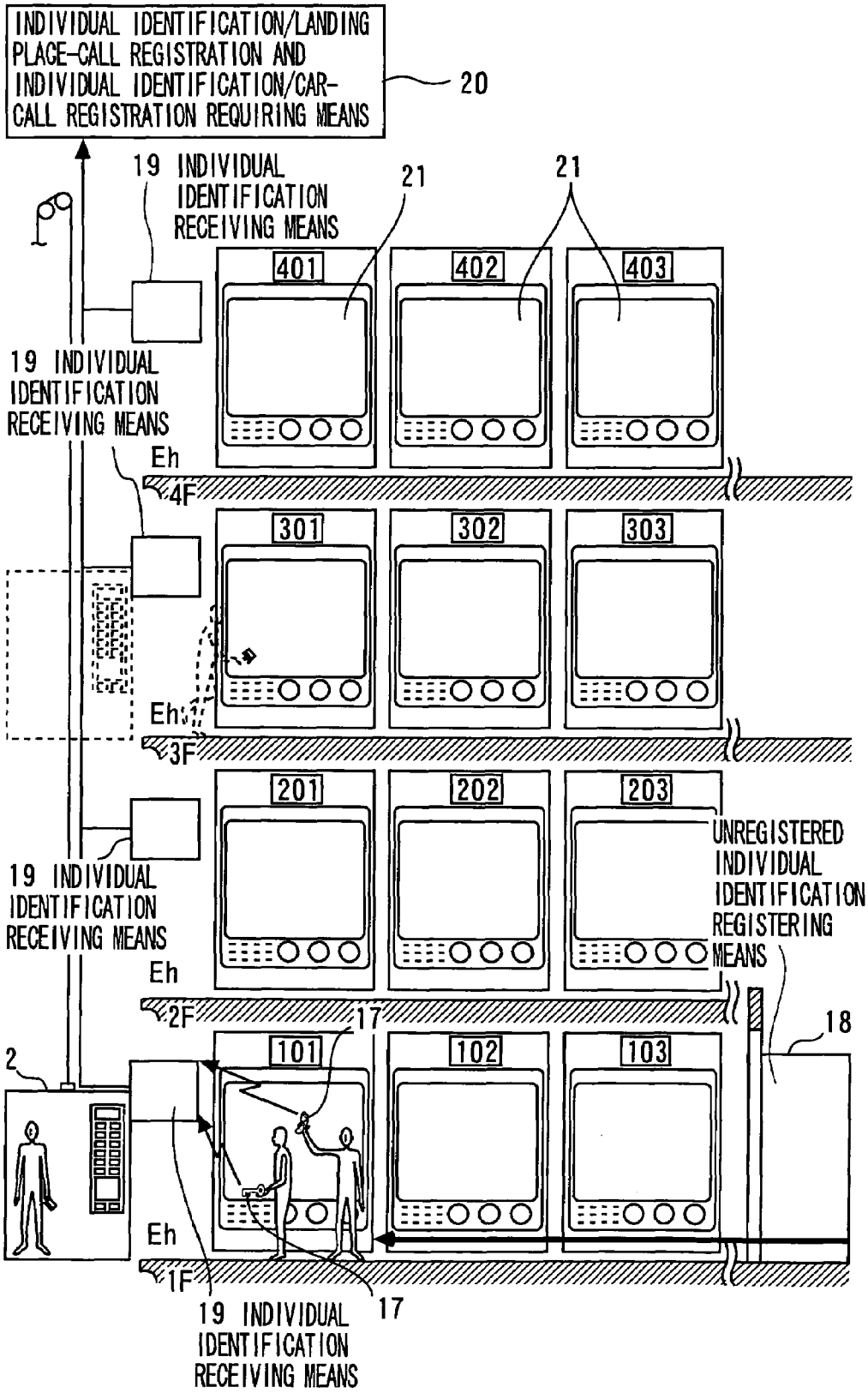
FIG. 20 is a block diagram which shows a partial construction of a fire control system of an elevator related to Embodiment 1 of the present invention, which is obtained by adding improvements to the fire control system of an elevator on which the present invention is based, which fire control system is shown in FIGS. 1 to 19.
Figure 21:
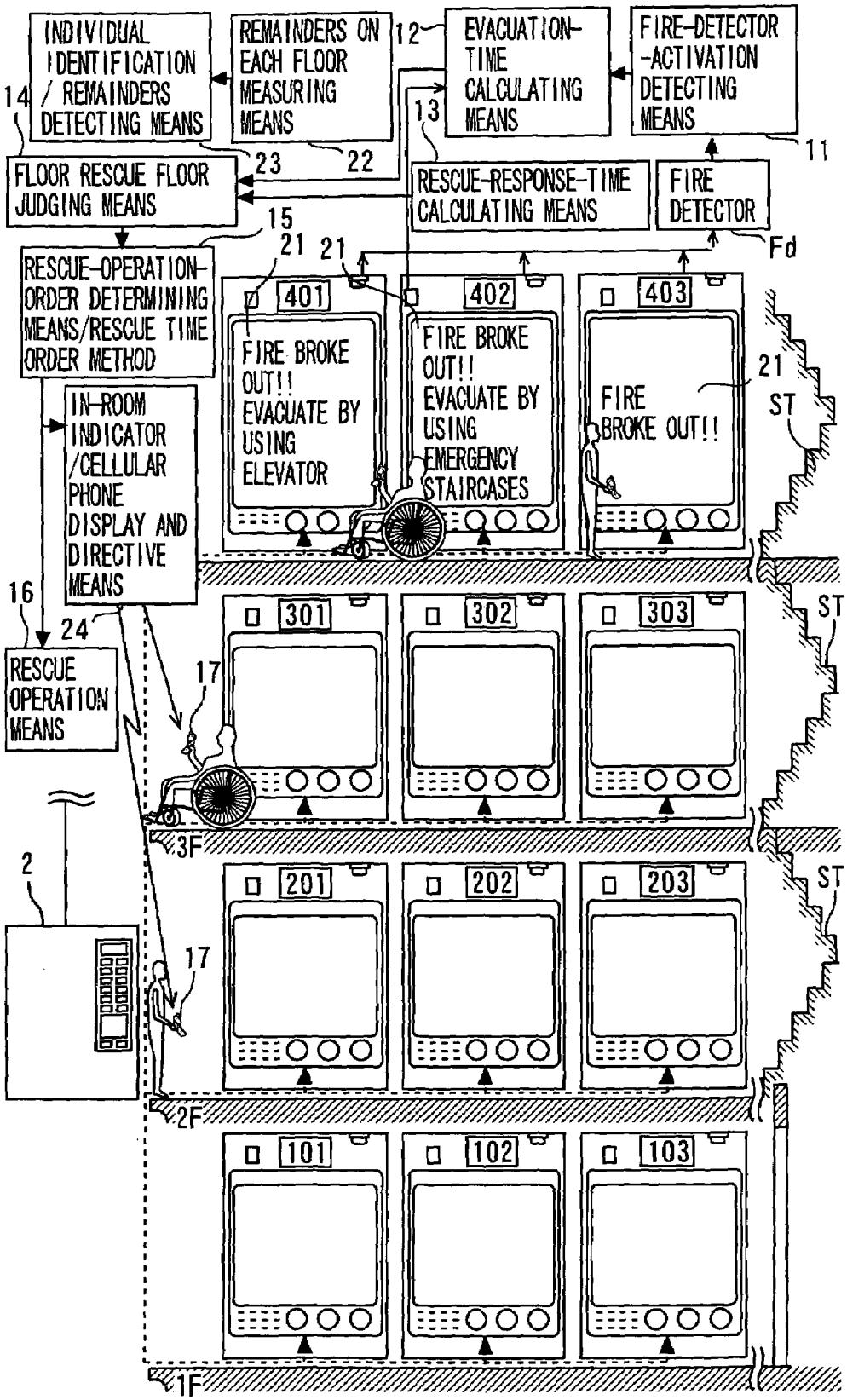
FIG. 21 is a block diagram which shows a partial construction of a fire control system of an elevator related to Embodiment 1 of the present invention, which is obtained by adding improvements to the fire control system of an elevator on which the present invention is based, which fire control system is shown in FIGS. 1 to 19.

FIGS. 20 and 21 each show a partial construction of a fire control system of an elevator related to Embodiment 1 of the present invention, which is obtained by adding improvements to the fire control system of an elevator on which the present invention is based, which fire control system is shown in FIGS. 1 to 19. FIG. 20 is a block diagram which shows how individual identification information sent from terminals carried by individuals during an elevator use is received and utilized, and FIG. 21 is a block diagram which shows how rescue operations during a fire, evacuation guidance signs to individual remainders and the like are notified. In Embodiment 1 of the present invention, the invention will be described by taking a case where the present invention is applied to a four-storied apartment building as an example. However, the present invention is not limited to this and can also be applied to an office building and a multi-tenant building.

This apartment building is a four-storied condominium building with the first story (1F) to the fourth story (4F) and each floor has multiple residential rooms (101 to 103, 201 to 203, 301 to 303, 401 to 403). Each occupant of this apartment building uses an elevator car 2 and moves up and down within the apartment building carrying portable individual identification sending means 17 in which identification information is registered. This identification information is, for example, a residential room number, a residential floor, characteristic information of an individual who carries the portable individual identification sending means (an able-bodied person or a physically-handicapped person). This individual identification sending means 17 performs the registration of an elevator landing place call and the registration of a car call of a residential floor after the arrival of an elevator. For a visitor from outside, individual identification information is not registered beforehand. Therefore, after reception procedures have been completed, for example, in a building manager office at the entrance, portable individual identification sending means 17 in which individual identification information, which is effective only once, has been registered by use of unregistered individual identification registering means 18 is handed to the visitor. As concrete examples of the portable individual identification sending means 17 in which individual identification information has been registered, for example, a key provided with a noncontact tag, a card provided with a noncontact tag, a cellular phone provided with a noncontact tag, etc. are conceivable. Individual identification receiving means 19 which receives an individual identification signal from the individual identification sending means 17 is installed in each elevator hall Eh or hoistway. The signal received by the individual identification receiving means 19 is sent to individual identification/landing place-call registration and individual identification/car-call registration requiring means 20 provided in an elevator controller 10 and a destination floor is automatically registered from individual identification information. Owing to the series of pieces of individual identification information and automatic registration of a destination floor of each individual, the destination floor information of each individual during an elevator use and the characteristic information of each individual (an able-bodied person or a physically-handicapped person) can be recognized by being correlated to each other. And the number of remainders on each floor can be measured from destination floor information. In each residential room, there is installed an in-room indicator 21 which is constituted by monitors etc. working in collaboration with an intercom. In FIG. 21, the character Fd denotes a fire detector, the numeral 11 fire-detector-activation detecting means, the numeral 12 evacuation-time calculating means, the numeral 13 rescue-response-time calculating means, the numeral 14 floor rescue floor-judging means, the numeral 15 rescue-operation-order determining means, and the numeral 16 rescue operation means; all these being the same as described in the fire control system of an elevator on which the present invention is based, which fire control system is shown in FIGS. 1 to 19. The numeral 22 denotes remainders on each floor measuring means which measures the number of remainders on each floor from destination floor information, and the numeral 23 denotes individual identification/ remainders detecting means. Owing to individual identification information and automatic registration of a destination floor of each individual by the individual identification sending means 17 and the individual identification receiving means 18, this individual identification/ remainders detecting means can recognize the destination floor information of each individual during an elevator use and the characteristic information of each individual (an able-bodied person or a physically-handicapped person) by correlating the destination floor information of each individual and the characteristic information of each individual to each other, with the result that it is possible to realize high-accuracy grasping of the number of remainders on each floor and grasping of the characteristic information of the remainders (an able-bodied person or a physically-handicapped person). The numeral 24 denotes in-room indicator/cellular phone display and directive means, which displays messages, such as FIRE BROKE OUT!! EVACUATE BY USING ELEVATOR, in a residential room of a physically-handicapped person (Room No. 401) or a cellular phone carried by the physically-handicapped person, and which displays messages, such as FIRE BROKE OUT!! EVACUATE BY USING EMERGENCY STAIRCASES, in a residential room of an able-bodied person (Room No. 402) or a cellular phone carried by the able-bodied person. As a result of this, it is possible to perform "the weak-first" evacuating operations by an elevator in which the characteristics of persons to be rescued are considered and, at the same time, it is possible to provide an evacuation-guidance sign system which is effective also for able-bodied persons.

EMBODIMENT 2

In Embodiment 1, descriptions were given of a system in which a key provided with a noncontact tag, a card provided with a noncontact tag, a cellular phone provided with a noncontact tag, etc. are used as the individual identification sending means 17. However, the present invention can also be easily carried out in a system in which a fingerprint matching device and a card reader are used as the individual identification means.

EMBODIMENT 3

In Embodiment 1, a case in which the in-room indicator 21 is installed in each residential room was described. However, the present invention can also be easily carried out in a case where a dedicated server is installed in a telephone company and telephone calls are given to a cellular phone of each individual in liaison with an elevator system.

EMBODIMENT 4

In Embodiment, a description was given of a case where the number of remainders and personal characteristics are detected by the individual identification device. However, detection of the number of remainders and personal characteristics by use of a portable terminal of a GPS (global positioning system) can be easily carried out. Also, for evacuation guidance and directions to each individual, the movement of building occupants can be positively detected by use of a portable terminal of a GPS and evacuation guidance and directions in which positions are considered can be easily outputted to the remainders.

INDUSTRIAL APPLICABILITY

As described above, a fire control system of an elevator related to the present invention can be widely used as evacuation means and evacuation guiding means during a fire by being applied to a residential elevator provided in a building provided with an elevator, such as an apartment building. For example, when this fire control system of an elevator is applied to an office building, employees working in the office building are given individual identification sending means and they are made to carry the individual identification sending means all the time. In the case of persons coming from outside on a business trip or visitors, individual identification sending means in which individual identification information, which is effective only once, has been registered by use of unregistered individual identification registering means is issued each time they visit the office building and they are made to carry the individual identification sending means so that the situation can be easily coped with.

The invention claimed is:

1. A fire control system of an elevator which rescues remainders in a building to an evacuation floor by causing an elevator car to perform rescue operations when a fire detector installed in the building works, characterized in that the fire control system of an elevator comprises: individual identification sending means which each individual who utilizes the elevator carries and in which identification information of each individual is registered; individual identification receiving means provided in each elevator hall; and a controller which calls an elevator car and performs car-call registration of a destination floor on the basis of information sent from the individual identification sending means to the individual identification receiving means, the controller including remainders -on-each-floor measuring means which calculates the number of remainders on each floor from car-call registration information of the destination floor, remainders -on-each-floor detecting means which detects the calculated number of remainders on each floor, and rescue operation means which performs rescue operations on the basis of the detected number of remainders on each floor.

2. A fire control system of an elevator which rescues remainders in a building to an evacuation floor by causing an elevator car to perform evacuating operations when a fire detector installed in the building works, which is characterized in that the fire control system of an elevator comprises: individual identification sending means which each individual who utilizes the elevator carries and in which a resident room number, a resident floor, information on characteristics of each individual, etc. are registered; individual identification receiving means provided in each elevator hall; and a controller which calls an elevator car and performs car-call registration of a destination floor on the basis of information sent from the individual identification sending means to the individual identification receiving means, the controller including remainders -on-each-floor measuring means which calculates the number of remainders on each floor from car-call registration information of the destination floor and grasps personal characteristics of remainders, remainders -on-each-floor detecting means which detects the calculated number of remainders on each floor and the grasped personal characteristics of remainders, rescue operation means which performs rescue operations on the basis of the detected number of remainders on each floor, and evacuation guiding and direction giving means which performs evacuation guidance and giving directions during a fire on the basis of the grasped personal information of remainders.

3. The fire control system of an elevator according to claim 2, characterized in that evacuation guidance signs during a fire from the evacuation guiding and direction giving means are displayed in the individual identification sending means.

4. The fire control system of an elevator according to claim 2, characterized in that evacuation guidance signs during a fire from the evacuation guiding and direction giving means are displayed in an in-room indicator provided in a residential room.

5. The fire control system of an elevator according to claim 2, characterized in that the evacuation guiding and direction giving means which performs evacuation guidance and giving directions during a fire judges information on personal characteristics obtained from an individual identification sending device carried by an elevator user and outputs optimum evacuation guidance and directions for each residential room, each floor and each individual identification sending means.

* * * * *